US005700043A

United States Patent [19]

Rohard et al.

[11] Patent Number: 5,700,043

[45] Date of Patent: Dec. 23, 1997

[54] DISCONNECTABLE CONNECTING DEVICE FOR TWO COMPONENTS WITH A NON-CIRCULAR OUTLINE, PARTICULARLY OVAL

[75] Inventors: Michel Rohard, Houssay; Charles Glachet, Vendome, both of France

[73] Assignee: La Calhene, Velizy Villacoublay, France

[21] Appl. No.: 658,347

[22] Filed: Jun. 5, 1996

[30] Foreign Application Priority Data

Jun. 9, 1995 [FR] France ..... 95 06838

[51] Int. Cl.[6] ..... B65D 45/30

[52] U.S. Cl. ..... 292/256.6; 292/39; 292/161; 292/256.5

[58] Field of Search ..... 292/256.5, 256.6, 292/6, 7, 39, 40, 68, 66, 160, 161, 217

[56] References Cited

U.S. PATENT DOCUMENTS

| | | | |
|---|---|---|---|
| 1,136,254 | 4/1915 | Mosler et al. | 292/39 X |
| 1,404,476 | 1/1922 | Paterson | 292/7 X |

FOREIGN PATENT DOCUMENTS

| | | | |
|---|---|---|---|
| 245696 | 11/1987 | European Pat. Off. . | |
| 823456 | 10/1937 | France | 292/161 |
| 626330 | 2/1936 | Germany | 292/161 |
| 9304733 | 7/1993 | Germany . | |
| 32393 | 3/1934 | Netherlands | 292/40 |
| 8600694 | 10/1987 | Netherlands | 292/256.5 |
| 848831 | 7/1981 | U.S.S.R. | 292/256.6 |
| 2181777 | 4/1987 | United Kingdom | 292/256.5 |

*Primary Examiner*—Rodney M. Lindsey

*Attorney, Agent, or Firm*—Pearne, Gordon, McCoy & Granger LLP

[57] ABSTRACT

To ensure the disconnectable connection of two components with a non-circular outline, in particular an oval outline, a rotatable ring of oval shape is fitted on a first component, cooperating with a second component by a bayonet system. Rotation of the ring is made possible by positioning at least four arc of a circle shaped segments along the desired outline with a space between the ends of adjacent segments. The link between these ends is made by articulated components.

10 Claims, 3 Drawing Sheets

DISCONNECTABLE CONNECTING DEVICE FOR TWO COMPONENTS WITH A NON-CIRCULAR OUTLINE, PARTICULARLY OVAL

TECHNOLOGICAL FIELD

The invention relates to a device designed to allow the disconnectable connection of two components with a non-circular shaped outline such as an oval outline.

The invention is applicable in all cases where it is wished to couple and to uncouple two components with a non-circular outline, for example, an oval outline. It can be used particularly to connect a door to an oval shaped opening formed in a confinement enclosure or in a container. It can also be used to connect together an enclosure door and a container door when the latter has itself been connected to the enclosure. Furthermore, the invention also allows the connection of the container to the enclosure.

STATE OF THE ART

In industries which require working in a space, isolated from the external atmosphere, i.e. a sealed confinement enclosure, it is customary to operate the input and the output of the different products and apparatus by means of containers connected to the enclosure with a double-door, sealed transfer device. The industries concerned with this technology are, in particular, the pharmaceutical, medical, foodstuffs and nuclear industries, etc.

In such a sealed, double door, transfer device, the enclosure and the container usually have circular openings defined by flanges and normally closed by doors. Each of the doors is attached to its corresponding flange by a disconnectable connecting device. A disconnectable connecting device is also provided between the flange of the container and the flange of the enclosure and between the container door and the enclosure door.

This known arrangement allows firstly the connection of the container flange to the enclosure flange, then the control, from inside the enclosure, of successively, the coupling of the two doors and then, their disconnection from their respective flanges.

When it is wished to avoid carrying out the connection or the disconnection of at least some of the components involved in such sealed, double door, transfer device without relative rotation of these components, it is known to fit one of the components concerned with a circular rotatable ring which cooperates with the second component through bayonet type connection means. This known solution has the advantage that it does not damage the jointing seals which are fitted on the two components since it does not result in any relative rotation between these seals. Furthermore, the bayonet connection means which are provided between the ring and the second component can be provided with tapers which ensure the desired squeezing of the jointing seals when this is necessary.

The numerous advantages arising from the use of such rotating ring connecting devices have lead to the practically universal use of double door, sealed transfer devices using circular shaped openings.

However, situations exist in which the use of circular shaped openings is not possible. Such a situation exists particularly when it is wished to transfer objects having a small height but a large width, which would necessitate circular openings impossible to establish, when the space occupied by the cell or its small dimensions are taken into account. In such a case, the transfer of objects requires that the openings be given an oblong shape and are, for example oval. However, existing connecting devices such as devices with a rotating ring require the rotation of one component, which is made impossible in the case where the outline of the connection has a shape other than circular.

DISCLOSURE OF THE INVENTION

The object of the invention is specifically a disconnectable connecting device whose original design allows the connection of two components having an outline shape other than circular, using a mobile control ring of the same shape.

In accordance with the invention, this result is achieved by means of a disconnectable connecting device for two components having a closed outline, this device including a ring conforming in shape to the outline and supported by a first component in such a way that it may be displaced along this outline between two extreme positions, and the connecting means positioned between the ring and the second component and capable of taking up an interlocking condition and an unlocking condition, when the ring occupies said extreme positions, characterised by the fact that the outline is not circular and by the fact that the ring includes at least three segments which follow the shape of said outline and linkage components linking the components end to end ensuring a space between adjacent ends of consecutive segments.

Preferably, each of the linkage components is articulated on the adjacent ends of two consecutive segments by two pins separated by an identical distance.

In one preferred embodiment, only the segments of the ring are linked to the first component by linkage and guidance means following said closed, non-circular outline.

These linkage and guidance means then include at least one series of grooves following the closed, non-circular outline, made in the segments of the ring.

In particular, the linkage and guidance means can include two series of grooves following the closed, non-circular outline, the sides of which are oriented respectively perpendicular to and parallel to the plane of the outline. The guidance means also include two sets of guides carried by the first component and received respectively in each of the series of grooves so as to contact their sides.

The connecting device according to the invention can be used, in particular, to connect a door to a flange defining an opening formed in a wall, having a non-circular outline.

The device according to the invention can also be used to connect two doors normally closing openings defined by flanges respectively in the wall of an enclosure and in the wall of a container with the outline previously mentioned.

Furthermore, the device according to the invention can be used to connect two flanges, defining openings normally closed by doors, respectively in the wall of an enclosure and in the wall of a container with the outline previously mentioned.

In the preferred embodiment of the invention, the outline and the ring have an oval shape, the ring including two first arc of a circle segments of relatively large diameter and two second arc of a circle segments of relatively small diameter linked end to end, in alternate fashion, by four linkage components.

BRIEF DESCRIPTION OF THE DRAWINGS

A preferred embodiment of the invention will now be described as a non-limiting example with reference to the appended drawings in which.

DETAILED DESCRIPTION OF ONE EMBODIMENT

Figure 1A:
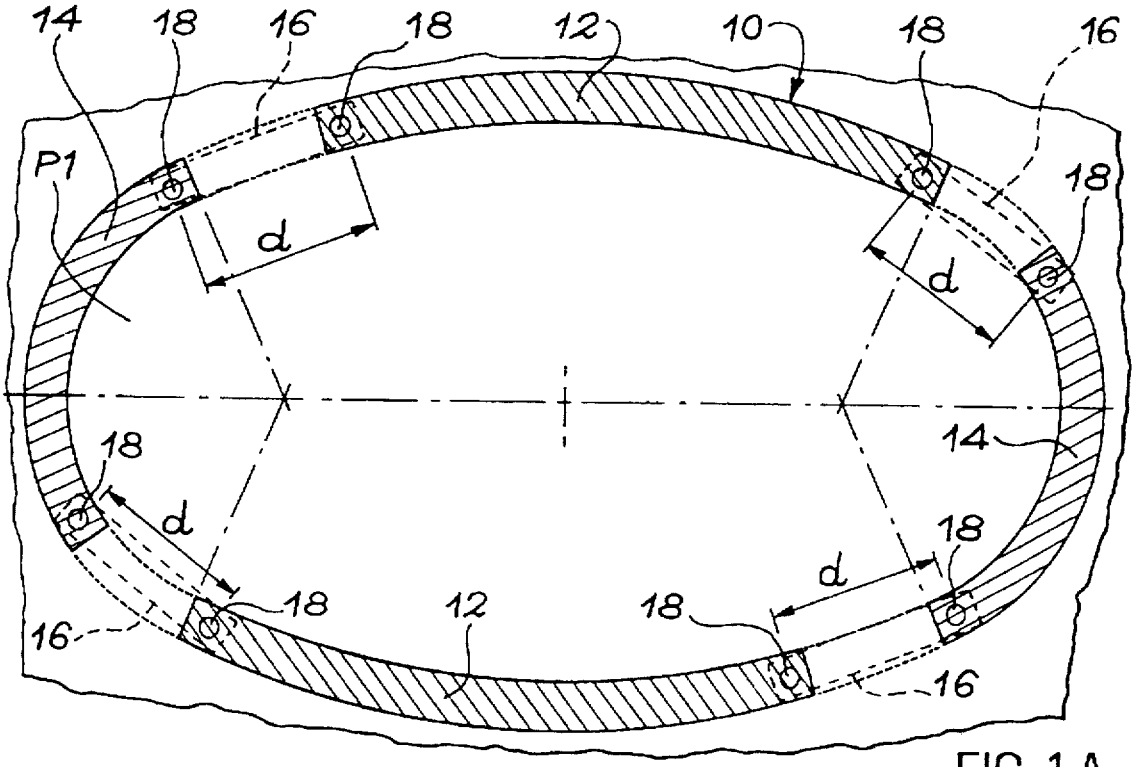
FIGS. 1A and 1B are front views showing an oval shaped ring provided for use in a disconnectable connecting device conforming to the invention, this ring being shown in its two extreme positions in these Figures so as to illustrate its rotating movement.
Figure 1B:
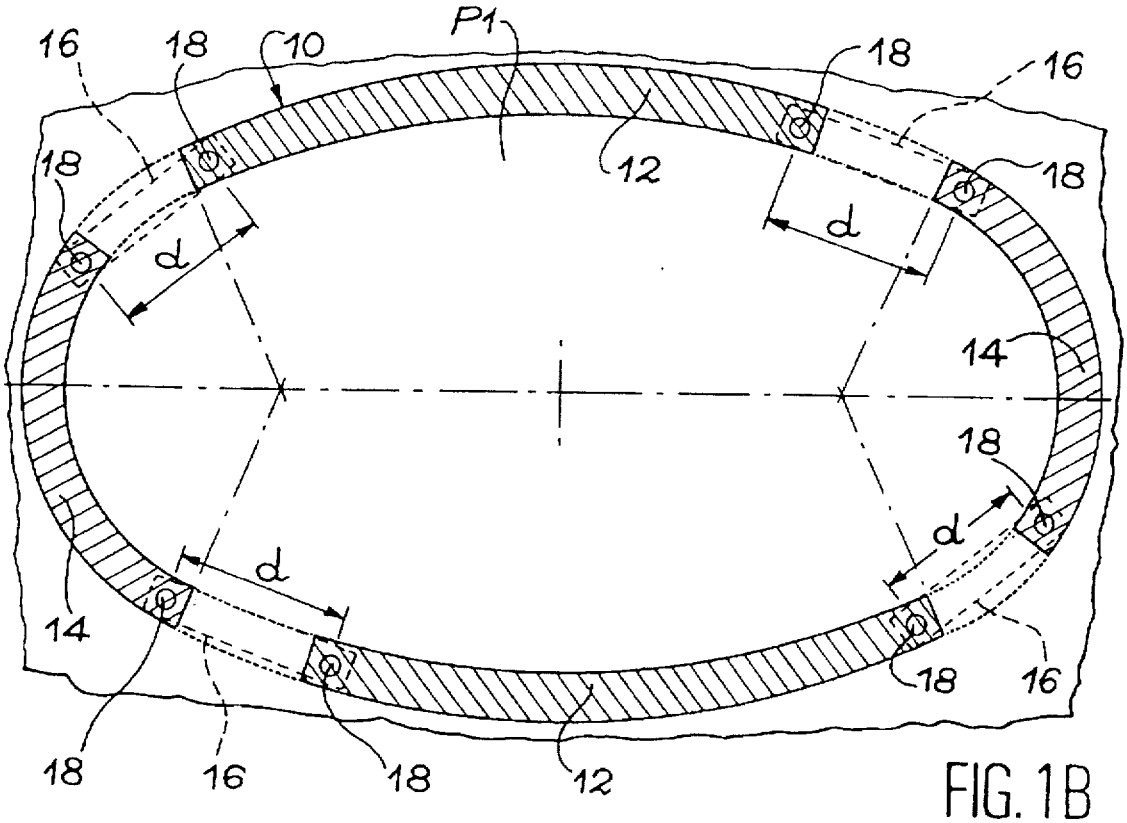

In FIGS. 1A and 1B, a ring 10 designed to be used in accordance with the invention in a disconnectable connecting device which allows two components with an oval outline shape to be connected, is shown in two different positions.

This ring 10, has itself the oval shape, similar or identical to the oval defined by the outline of the two components.

More precisely, the ring 10 includes two first arc of a circle segments 12, identical to one another, and two second arc of a circle segments 14, also identical to one another. The first segments 12 and the second segments 14 are positioned end to end and in an alternate way, in such a way as to have the oval shape previously mentioned.

More precisely, each of the two first segments 12 of the ring 10 has a relatively large diameter which corresponds to the large diameter of the large diameter sections of the oval. However, their angular length is less than the angular length of the corresponding sections of the oval.

In a comparable way, the second segments 14 of the ring 10 have a relatively small diameter which corresponds to the small diameter of the corresponding sections of the oval previously mentioned. However, the angular length of these second segments 14 is also less than the angular length of the corresponding sections of the oval.

Consequently, the adjacent ends of the first segments 12 and the second segments 14 are all spaced apart as shown in FIGS. 1A and 1B. To link these adjacent ends together, ring 10 is completed by four linkage components 16, shown in broken lines in FIGS. 1A and 1B. In the embodiment shown, these linkage components 16 are rectilinear. They can however have a slightly different shape without departing from the scope of the invention.

Each of the linkage components 16 is articulated at adjacent ends of segments 12 and 14 by pins 18 oriented perpendicular to the plane of the ellipse. The distance d between the two pins 18 of one linkage component 16 is identical for the four components 16.

Because of this arrangement and as illustrated more precisely in FIGS. 1A and 1B, the ring 10 can itself turn along a path identical with its own oval shape. The travel of this movement is determined by the distance d that separates the adjacent ends of sections 12 and 14 forming the ring 10.

Hence, in a first extreme position illustrated in FIG. 1A, a first end of each of the segments 12 and 14 is coincident with the end of the corresponding sections of the oval, while the opposite end of each of the segments 12 and 14 is remote from the second end of these sections. Starting from this first position, it is possible to turn each of the segments 12 and 14 to the second end of the sections of the oval with a defined maximum angle. Then the second extreme position is reached, as illustrated in FIG. 1B. Rotation of the ring 10 in the opposite direction, over the same distance is then possible.

When it is integrated into a disconnectable connecting device according to the invention, ring 10 is mounted on a first component P1, so that it can move relative to this component in the manner which has just been described with reference to FIGS. 1A and 1B. To carry out the assembly of the ring 10 on the first component P1, linkage and guidance means are used which allow both the maintenance of the link between the ring and the component and guidance of the displacement of the ring in rotation along the path defined by the oval. Examples of how these linkage and guidance means are implemented will be described below with reference to FIGS. 2 to 4.

In addition, in order that the rotational movement of ring 10 on the component P1, between the two extreme positions illustrated in FIGS. 1A and 1B can result in interlocking and unlocking the connecting device, the ring 10 cooperates with a second component (not shown) by bayonet connection means the implementation of which will be explained below with reference to FIGS. 2 to 4.

Figure 2:
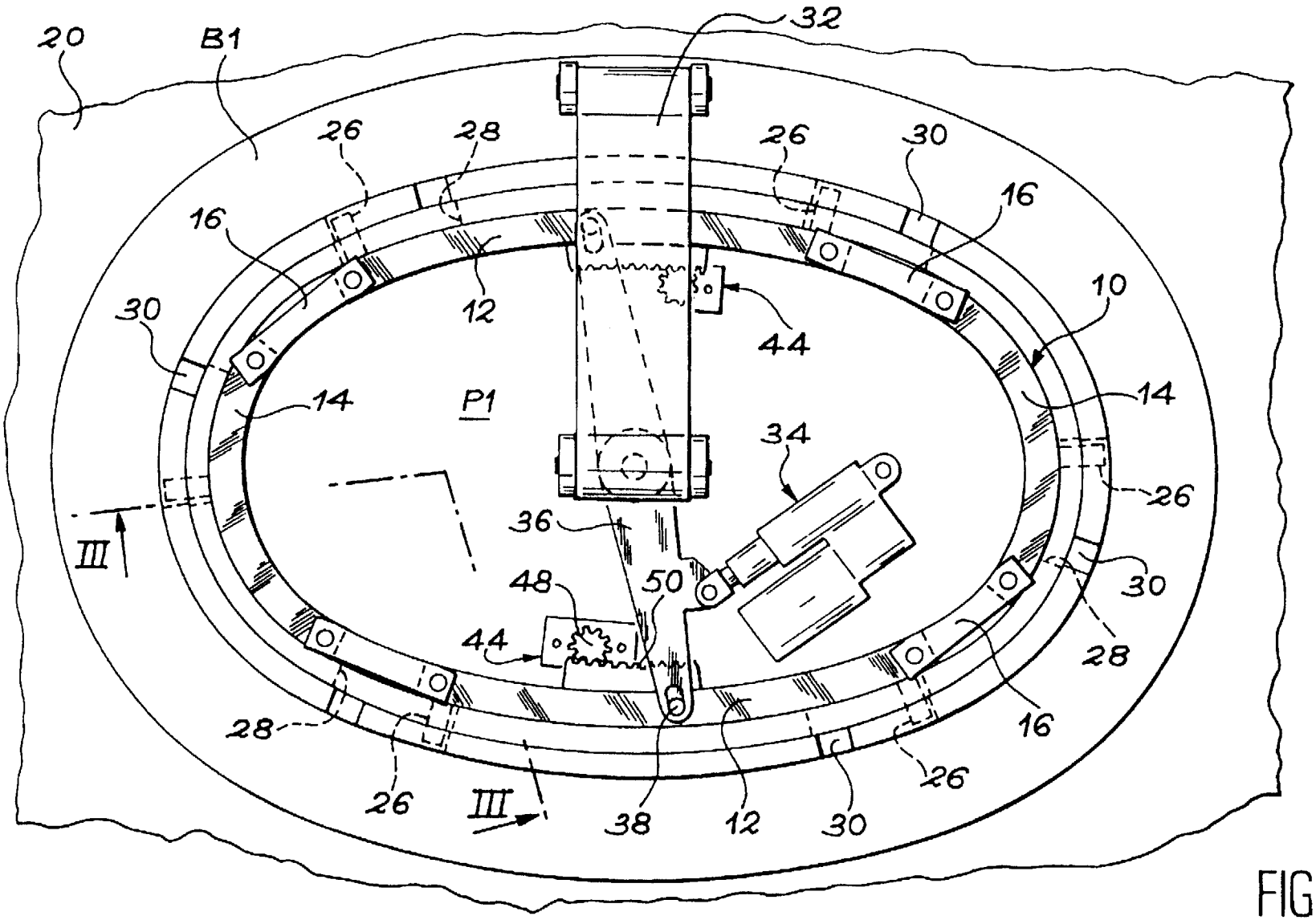
FIG. 2 is a view taken from the inside of a confinement enclosure, showing a disconnectable connecting device, conforming to the invention, by which a door can be connected and disconnected from a flange defining an oval shaped opening.
Figure 3:
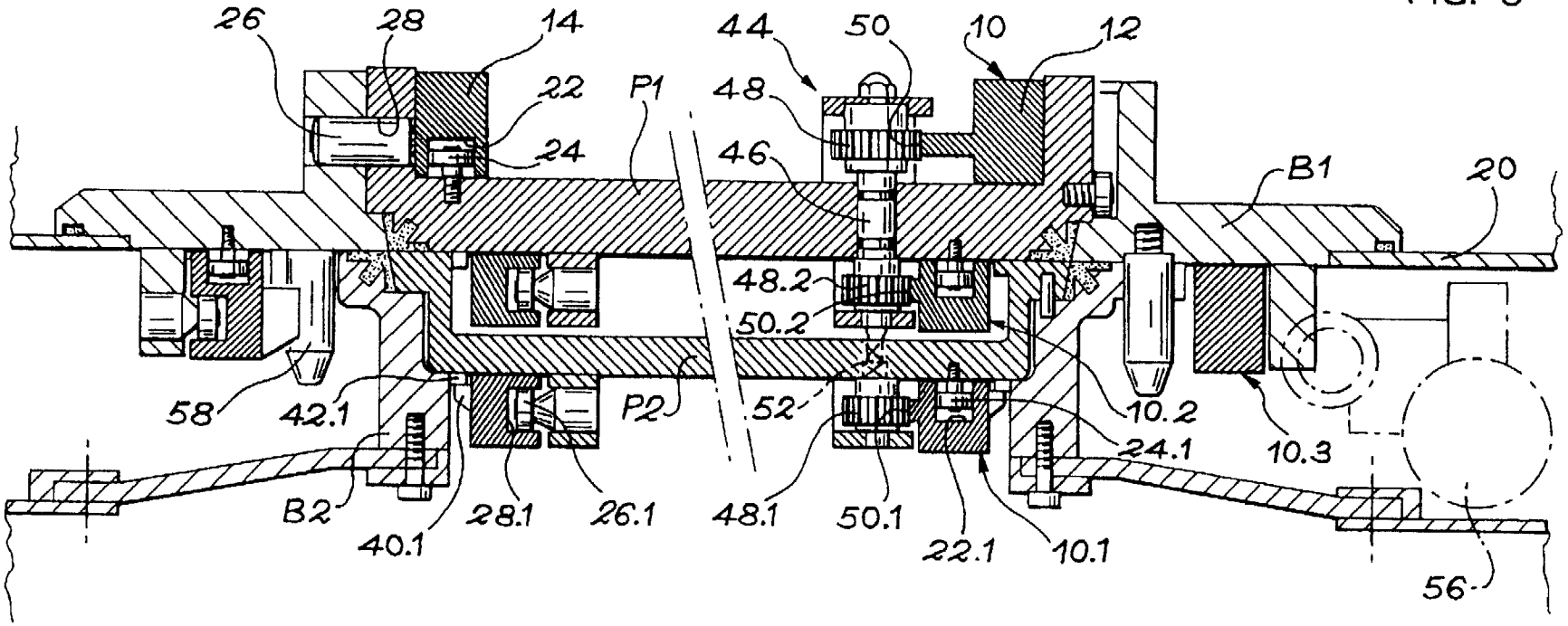
FIG. 3 is a section view on a larger scale taken along the line III—III of FIG. 2, in the case where a container, fitted with a door is attached to the flange of the enclosure by means of a similar connecting device.
Figure 4:
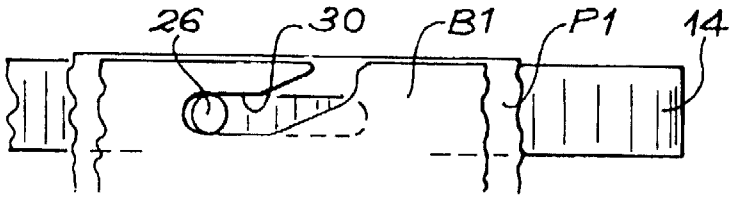
FIG. 4 shows detail of the bayonet connecting means provided between the ring of the connecting device illustrated in FIG. 2 and the flange of the enclosure.

In FIGS. 2 and 3, is shown an application of the disconnectable connecting device according to the invention for the connection of a cell door P1 to a cell flange B1 defining an oval shaped opening in the wall 20 of a sealed confinement cell.

In this case, the cell door P1 comprises the first component on which the ring 10 is mounted. It is made, in the manner previously described with reference to FIGS. 1A and 1B, by assembling two first segments 12 and two second segments 14 by means of linkage pieces 16 articulated at the ends of adjacent segments.

The linkage and guidance means by which ring 10 is mounted on cell door P1 includes grooves 22 (FIG. 3) with an oval shape, made in the segments 12 and 14 of ring 10, on the surface of these segments facing door P1. The sides of these grooves 22 are oriented perpendicular to the plane of the oval shaped outline which the ring must follow during its movement, and parallel to this outline.

The linkage and guidance means further comprise guides 24 which are received in the grooves 22 and whose spindles are fixed to the face of door P1 carrying ring 10. More precisely, the guide 24 spindles are parallel to the sides of grooves 22, so that the guides are in contact with these sides. Guidance of the ring 10 over door P1 along the oval path previously defined is thereby assured.

So as to ensure the link between the ring 10 and the door P1, the linkage and guidance means further include guides 26 the spindles of which are carried by the segments 12 and 14 of ring 10 projecting radially outwards relative to the latter. These guides 26 pass through slots 28 formed in an external peripheral flange of door P1 surrounding ring 10. This arrangement allows the link between ring 10 and the door P1 to be maintained without preventing rotation of the ring relative to the door.

Furthermore, the guides 26 project outwards beyond the slots 28 to form one of the parts of the bayonet linkage means by which the ring 10 cooperates with the cell flange B1. As is illustrated particularly in FIGS. 3 and 4, the ends of guides 26 which project beyond slots 28 are received in the open notches 30 formed in a peripheral edge of the flange B1 surrounding the external peripheral flange of door P1 in which the slots 28 are formed.

Thanks to this arrangement, it can be understood that rotation of ring 10 in one direction or another, allows one either to connect door P1 to flange B1 or on the contrary, to ensure disconnection.

In the embodiment illustrated in FIG. 2, an articulated arm 32 permanently links door P1 to the flange B1. Using this articulated arm, when the connecting device according to the invention is disconnected, it is possible to swing door P1 into the inside of the cell so as to clear completely the oval shaped opening defined by the flange B1.

Furthermore, the embodiment illustrated in FIG. 2 shows a double acting cylinder 34 mounted on door P1, in a way that controls the rotation of the ring 10 in both directions. More precisely, the body of cylinder 34 is fixed to the surface of the door P1 facing the inside of the confinement cell, so that the piston of the cylinder is loosely articulated onto a lever 36. This lever 36 is itself pivotally mounted on the centre of the surface of the door P1 facing the inside of the cell, and each of its ends is loosely engaged with one of the first segments of the ring 10 via an articulated linkage 38. More precisely, lever 36 acts approximately at the centre of each of the segments 12 via linkages 38.

Thanks to this arrangement, it can be understood that actuation, in one direction or the other, of the cylinder 34 allows controlling a rotation of the ring 10 in one direction or the other, by exerting balanced forces on this ring which enable the effectiveness of the control to be improved.

To make it easier to read FIG. 3, neither the articulated arm 32 nor the means which allow control of the rotation of ring 10 have been shown.

In FIG. 3, the device which has just been described, to ensure the disconnectable connection of the cell door P1 to the cell flange B1, is shown integrated with a sealed, double door, transfer device, through which different products and apparatus can be transferred between the confinement cell and a container, via an oval shaped opening.

More precisely, FIG. 3 illustrates the case where the connection of the container door P2 to the container flange B2, the connection of the container flange B2 to the cell flange B1 and the connection of the container door P2 to the cell door P1 are all made by means of disconnectable connecting devices according to the invention. It should be understood, however, that at least one of these devices, such as that which links the container flange B2 to the cell flange B1, can be made in a different way, without departing from the scope of the invention.

Hence, it is seen in FIG. 3 that the container door P2 carries, on the surface facing the interior of the container, a ring 10.1 made completely in the same way as the ring 10 mounted on the cell door P1.

The movements of the ring 10.1 mounted on the container door P2 are controlled by the linkage and guidance means, which, as before, include means which allow the link to be made between the ring and the door and means allowing the ring to be guided in its rotational movement.

To make the link between the ring 10.1 and the door P2, in this case, guides 26.1 are used the spindles of which are carried by a part of the container door P2 positioned inside ring 10.1 and which project radially outwards with respect to this part of the door. The guides 26.1 are received in grooves 28.1 machined on the inside facing surfaces of the first and second segments of the ring 10.1. The sides of the grooves 28.1 are oriented parallel to the plane of the oval shaped outline. Consequently, the contact of the guides 26.1 with the sides of the grooves 28.1 ensures the link between the ring and the container door P2.

In addition, the guidance of the displacement of the ring 10.1 on the container door P2 is effected by means comparable to those which assure the guidance of the displacement of the ring 10 on the cell door P1. More specifically, these linkage and guidance means include grooves 22.1 made on the surfaces of the first and second segments of the ring 10.1 facing the container door P2, as well as guides 24.1, received in the grooves 22.1 and the spindles of which are fixed to the surface of the container door P2 facing the inside of the container. These guides 24.1 are therefore in contact with the sides of grooves 22.1 and thereby ensure guidance of the rotational movement of ring 10.1 on the container door P2, following an oval path.

In this case, the bayonet linkage means which are provided between the ring 10.1 and the container flange B2 to allow the connection and the disconnection of the container door P2 include complementary lugs 40.1 and 42.1 formed respectively on the external surface of the first and second segments of ring 10.1 and on the internal surface of flange B2.

The structure of the connecting device provided in the example in FIG. 3 between the doors P1 and P2 is completely similar to that which has just been described to make the connection of door P2 to container flange B2. Therefore, it will not be described in detail. One should simply note here that this connecting device includes an oval and rotatable ring 10.2, carried in this case by the surface of the cell door P1 facing the outside of the cell, and which is made in an identical way to the rings 10 and 10.1 described previously. The same is true for the linkage and guidance means which link ring 10.2 and cell door P1.

In order for the coupling of container door P2 to cell door P1 and the disconnection of doors P1 and P2 from their respective flanges B1 and B2 to be controlled directly from the inside of the cell by the cylinder 34 of FIG. 2, two mechanisms 44 are advantageously provided, situated in diametrically opposite locations with respect to the centre of the oval.

Each of these mechanisms 44 include a spindle 46 which passes, in sealed fashion, through the cell door P1, inside one of the first segments 12 of the rings 10 and 10.2 mounted on each of the faces of the cell door. At its ends, the spindle 46 carries two pinions 48, 48.2 which mesh respectively with racks 50, 50.2 formed on the inside of the corresponding segment 12.

With this arrangement, it can be understood that rotation of the ring 10 controlled by the cylinder 34 is accompanied by a corresponding rotation of the ring 10.2.

So that a rotation of the ring 10.1, mounted on the container door P2 may also be controlled by the cylinder 34, each of the mechanisms 44 further has a second spindle 52 passing, in sealed fashion, through container door P2. When the container is docked on cell flange B1, the second spindle 52 is automatically in alignment with spindle 46 passing through cell door P1. Furthermore clutching means provided on the ends facing towards spindles 46 and 52, are automatically engaged.

On the surface of container door P2 facing the interior of the container, spindle 52 carries a pinion 48.1. This pinion 48.1 is engaged with a rack 50.1 formed on the inside of the first segment 12 of ring 10.1.

Thanks to this arrangement, actuation of the cylinder 34 allows to simultaneously control the rotation of rings 10, 10.2, and 10.1. In a conventional way, the travel of the bayonet connecting means placed between ring 10.2 and container door P2 is given a value which allows the connection of the two doors P1, P2 to be assured before they can be disconnected from their respective flanges.

As has already been mentioned, the double door, sealed transfer device illustrated in FIG. 3 includes a fourth disconnectable connecting device according to the invention, located between flanges B1 and B2.

This fourth disconnectable connecting device is made in the same way as the preceding ones, so a detailed description will not be made of it. It should simply be pointed out here that it also has a ring 10.3, supported in a way that permits rotation by the surface of the cell flange B1 facing the outside. This ring 10.3 is made in accordance with the invention in the manner which has been previously described with reference to FIGS. 1A and 1B. It cooperates directly with the flange of container B2 by bayonet connection means of conventional design. Furthermore, it is mounted on the cell flange B1 by linkage and guidance means similar to those by which the ring 10.1 is mounted on the container door P2.

The rotation of ring 10.3 is advantageously controlled separately by a cylinder 56 mounted on cell flange B1, only the outline of which is illustrated in broken line on FIG. 3.

To facilitate the docking of the container flange B2 onto the cell flange B1, the latter advantageously carries, on its outside facing surface, guide pins 58 having truncated conical ends extending beyond the ring 10.3. The ends of these guide fingers 58 engage notches appropriately formed on the end of flange B2.

Even if the connecting device according to the invention is particularly suitable for use in a double door, sealed transfer device, it may also be used in other areas and particularly for connecting pipeworks of oval section.

It should be noted that the oval shape of the outline of the oval connecting device described is not limiting and includes the case where the first segments of the ring have an infinite diameter, i.e. where these first segments are rectilinear. More generally, the outline of the connecting device according to the invention can also be of more diverse shapes such as: triangular, square, polygonal etc., the ring being formed from at least three segments, rectilinear or shaped as arcs of circles, linked end to end by articulated linkage components so that all the segments can slide simultaneously between interlocking and unlocking positions of the connecting means.

We claim:

1. A disconnectable connecting device for two components, this device comprising:

a ring having a non-circular shape, said ring including at least three segments arranged in end to end relationship along said non-circular shape, with spaced apart adjacent ends, and linkage components articulated only on said adjacent ends of the consecutive segments, for linking said segments and ensuring a space between said adjacent ends;

linkage and guidance means for having the segments supported by a first of said components, said means guiding the segments along a displacement direction following said non-circular shape, between two extreme positions; and connecting means for being placed between the ring and a second of said components, capable of being respectively in an interlocking condition and an unlocking condition, when the ring is in said extreme positions.

2. A device according to claim 1, wherein each of the linkage components is articulated on the adjacent ends of two consecutive segments by a pair of pins and the pins of each pair are separated from each other by an identical distance for all the linkage components.

3. A device according to claim 1, in which the linkage and guidance means include at least one series of grooves, following the non-circular shape, made in the segments of the ring.

4. A device according to claim 1, in which the linkage and guidance means include two series of grooves, following the non-circular shape, the sides of which are oriented respectively perpendicular to and parallel to a plane defined by of said ring and two sets of guides for being carried by the first component and received respectively in each of the grooves, to make contact with their sides.

5. A device according to claim 1, in which the first component is a door and the second component is a flange defining an oval opening formed in a wall, having said non-circular shape.

6. A device according to claim 1, in which the first and the second components are doors normally closing openings defined by flanges, respectively in a wall of an enclosure and in a wall of a container, having said non-circular shape.

7. A device according to claim 1, in which the first and the second components are flanges defining openings, normally closed by doors, respectively in a wall of an enclosure and in a wall of a container, having said non-circular shape.

8. A device according to claim 1, in which the ring is of an oval shape and includes two first arc of a circle segments of relatively large diameter and two second arc of a circle segments of relatively small diameter, linked end to end, in alternate fashion, by four said linkage components.

9. A disconnectable connecting device for two components, said device comprising:

a ring having a non-circular shape, formed of at least three successive arcs of circles, said ring including at least three arc-shaped segments arranged in end to end relationship along said non-circular shape, with spaced apart adjacent ends, each of said segments following a corresponding one of said arcs of circles, linkage components for linking the adjacent ends of the consecutive segments together, and pairs of pins for articulating each linkage component on the adjacent ends of the consecutive segments;

linkage and guidance means for having each segment connected and guided by a first of said components, along a displacement direction corresponding to a rotation following the corresponding one of said arcs of circles, between two extreme positions; and connecting means for being placed between at least one segment and the other component, capable of being respectively in an interlocking condition and an unlocking condition, when the segments are in said extreme positions.

10. A disconnectable connecting device for two components, said device comprising:

a ring having an oval shape, formed of four successive arcs of circles including two arcs of circle of a relatively large diameter and two arcs of circle of a relatively small diameter, arranged in alternate fashion, said ring including four arc-shaped segments arranged in end to end relationship and having spaced apart adjacent ends, each of said segments following a corresponding one of said arcs of circles, four linkage components for linking the adjacent ends of the consecutive segments together, and pairs of pins for articulating each linkage component on the adjacent ends of the consecutive segments;

linkage and guidance means for having each segment connected and guided by a first of said components, along a displacement direction corresponding to a rotation following the corresponding one of said arcs of circles, between two extreme positions; and connecting means for being placed between at least one segment and the other component, capable of being respectively in an interlocking condition and an unlocking condition, when the segments are in said extreme positions.

* * * * *